US005286033A

United States Patent [19]

Wayne

[11] Patent Number: 5,286,033

[45] Date of Patent: Feb. 15, 1994

[54] PARACHUTE GAME AND TARGET

[76] Inventor: Mark Wayne, 29436 Briarbank Ct., Southfield, Mich. 48034

[21] Appl. No.: 855,426

[22] Filed: Mar. 23, 1992

Related U.S. Application Data

[63] Continuation-in-part of Ser. No. 573,282, Aug. 24, 1990, Pat. No. 5,098,109.

[51] Int. Cl.[5] ..... A63B 65/00

[52] U.S. Cl. ..... 273/377; 273/374; 273/400; 273/428; 446/49

[58] Field of Search ..... 273/424; 428, 398, 398/402; 446/54; 273/334, 341, 351, 353, 377, 589, 374; 446/49, 54

[56] References Cited

U.S. PATENT DOCUMENTS

| | | | |
|---|---|---|---|
| 441,099 | 11/1890 | Hoyt | 273/353 |
| 930,452 | 8/1909 | Zook | 446/49 |
| 1,320,267 | 10/1919 | Pallen | 273/398 |
| 1,484,752 | 2/1924 | Apperson et al. | 273/351 |
| 1,775,299 | 9/1930 | Warner | 446/51 |
| 1,873,211 | 8/1932 | Nekuda | 273/398 X |
| 1,935,370 | 11/1933 | Nekuda | 273/341 |
| 2,101,276 | 12/1937 | Walter | 273/351 X |
| 2,388,513 | 11/1945 | Zwickel | 273/351 X |
| 2,440,885 | 5/1948 | Zamboni | 273/351 |
| 3,091,461 | 5/1963 | Taylor | 273/341 |
| 3,170,693 | 2/1965 | Felsher | 273/377 X |
| 3,208,444 | 9/1965 | Sipos | 273/341 X |
| 3,348,846 | 10/1967 | Atchison | 273/400 X |
| 3,455,553 | 7/1969 | Melvin | 273/377 X |
| 3,616,568 | 11/1971 | Powell | 446/50 |
| 3,798,829 | 3/1974 | Worley | 446/51 |
| 4,005,544 | 2/1977 | Donner | 446/51 |
| 4,014,546 | 3/1977 | Steinkamp | 273/374 |
| 4,038,776 | 8/1977 | Filipeli | 446/52 |
| 4,577,865 | 3/1986 | Shishido | 273/58 G |
| 4,595,200 | 6/1986 | Shishido | 273/58 G |
| 4,976,439 | 12/1990 | Kraemer | 273/140 X |
| 4,989,881 | 2/1991 | Gamble | 273/416 |
| 5,110,136 | 5/1992 | Land | 273/346 |

FOREIGN PATENT DOCUMENTS

| | | | |
|---|---|---|---|
| 915606 | 7/1946 | France | 273/428 |
| 1359978 | 3/1964 | France | 446/52 |
| 2583648 | 12/1986 | France | 273/58 G |
| 464531 | 7/1951 | Italy | 446/51 |
| 6392 | of 1905 | United Kingdom | 273/341 |

OTHER PUBLICATIONS

Popular Mechanics, Aug. 1958 vol. 110 No. 2 p. 178.

*Primary Examiner*—Paul E. Shapiro

*Attorney, Agent, or Firm*—Gifford, Groh, Sprinkle, Patmore and Anderson

[57] ABSTRACT

A parachute game includes a hand-tossable parachute assembly that is held by a player and is tossed at a target hoop. The parachute assembly comprises at least one hemispherical canopy attached to a body portion by a number of conically arrayed cords. The body portion includes at least one ring at its top end for cord attachment. In one embodiment, the body portion includes axially-placed stabilizing vanes. At its bottom side, the body portion may have defined therein a concave depression to assist in retarding the free fall of the body as it travels through the air. The target may either be a single marker or may be a series of concentric markers. Alternatively, the target may be a sheet that appears to be a view of land and may include miniature vehicles, buildings, monuments, pools of water, natural elevations and the like. An announcing system may be provided to alert the player as to the scoring of points. The body of the assembly may have the shape of a space craft, a human or an imaginary alien. The parachute and body assembly may be either tossed by hand or cast by a rod and reel assembly.

22 Claims, 3 Drawing Sheets

PARACHUTE GAME AND TARGET

This application is a continuation-in-part application of application Ser. No. 07/573,282 filed Aug. 24, 1990, U.S. Pat. No. 5,098,109.

BACKGROUND OF THE INVENTION

I. Field of the Invention

The present invention relates generally to children's toys. More particularly, the present invention relates to a parachute game including a hand-tossable parachute assembly that is held by a player and is tossed at a target hoop.

II. Description of the Relevant Art

Games are popular and varied. A secret to a successful game is to provide a game that is challenging as well as fun. A game that also involves physical interaction typically proves highly successful.

The problem with challenging, fun and physically interactive games is that they are often not playable indoors and, when played out-of-doors, require a considerable amount of playing area.

Game producers have generally failed in providing challenge, fun and physical activity into a single game. Such a game would be beneficial to players of all ages, although such a game is currently unavailable.

SUMMARY OF THE PRESENT INVENTION

The present invention provides a game that is simultaneously challenging, fun and physically interactive and discloses a parachute target game. The parachute game includes a hand-tossable parachute assembly that is held by a player and is tossed at a target. Preferably the target is a hoop horizontally placeable upon the ground or the floor of the room.

The parachute assembly comprises at least one hemispherical canopy attached to a body portion by a number of conically arrayed cords. The body portion is preferably composed of an injected, foamed polymerized plastic having a protective coating such as a paint filmed thereover.

At its top end, the body portion includes at least one ring for attachment to the canopy cords. To prevent twisting of the cords, two such rings are preferably fitted to the body portion whereby the rings are joined to the top of the body portion at their lower ends and are spaced apart at their upper ends thereby forming a "V" in cross section.

At the bottom side, of the body portion, there may be a concave depression to assist in retarding the free fall of the body portion as it descends after being tossed.

The body portion may also have axially provided thereon a number of stabilizing vanes. The vanes assist in minimizing twisting of the body portion after it has been thrown.

The game is played by placing the target hoop onto the ground or a floor or a similarly level surface. Thereafter, each player rolls the canopy and body portion substantially into a ball, takes aim at the target hoop, and tosses the assembly into the air in the hope that the assembly lands within the hoop.

The parachute game of the present invention offers several significant advantages. The game is challenging, yet fun. Tossing the assembly requires physical interaction, yet no physical contact with other players is required and the game is thereby safe for play. The game may also be played indoors or out-of-doors. Furthermore, the game may be constructed of relatively inexpensive materials and may be neatly packed and easily stored. The game may be played by people of all ages.

The target of the present invention may be a marker or a plurality or markers. The markers may be concentrically situated. As may be preferred, the individual markers may have score value signs placed near them. As an alternative to the marker target, the target of the present invention may include a sheet on which may be disposed miniature vehicles, natural elevations such as mountains, pools of water, buildings and monuments. Scoring is based upon which of these items are hit by the falling body.

The hit of a target may be signalled by a light or a sound such as a buzzer. The signalling unit may be included in either the body or in the target itself.

The shape and form of the body may be varied from a conical body to a space vehicle, a human shape or an imaginary alien shape.

The body and parachute assembly may be tossed by the player from the hand or may be cast with the use of a rod and reel assembly.

Other advantages and features of the present invention will become more apparent from the following detailed description when read in conjunction with the accompanying drawing.

BRIEF DESCRIPTION OF THE DRAWING

The present invention will be more fully understood by reference to the following description of the preferred embodiments of the present invention when read in conjunction with the accompanying drawings in which like reference characters refer to like parts throughout the views, and in which.

DETAILED DESCRIPTION OF THE PREFERRED EMBODIMENTS OF THE PRESENT INVENTION

Figure 1:
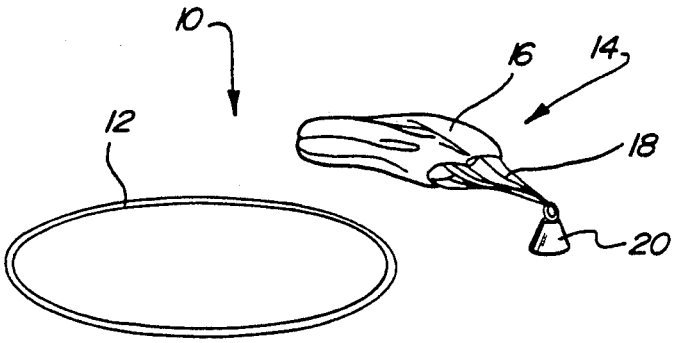
FIG. 1 is a peripheral view of the elements of the game according to the present invention.

The drawing discloses the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Referring to FIG. 1, a parachute game according to the present invention is illustrated generally as 10. The parachute game 10 includes a target portion 12 and a parachute assembly generally illustrated as 14. Although the target portion 12 is herein illustrated as being a hoop, it should be understood that other target structures such as bull's-eyes, open containers and the like may also be considered in game play.

The parachute assembly 14 includes a canopy 16, a plurality of cords 18, and a body portion 20.

Figure 2:
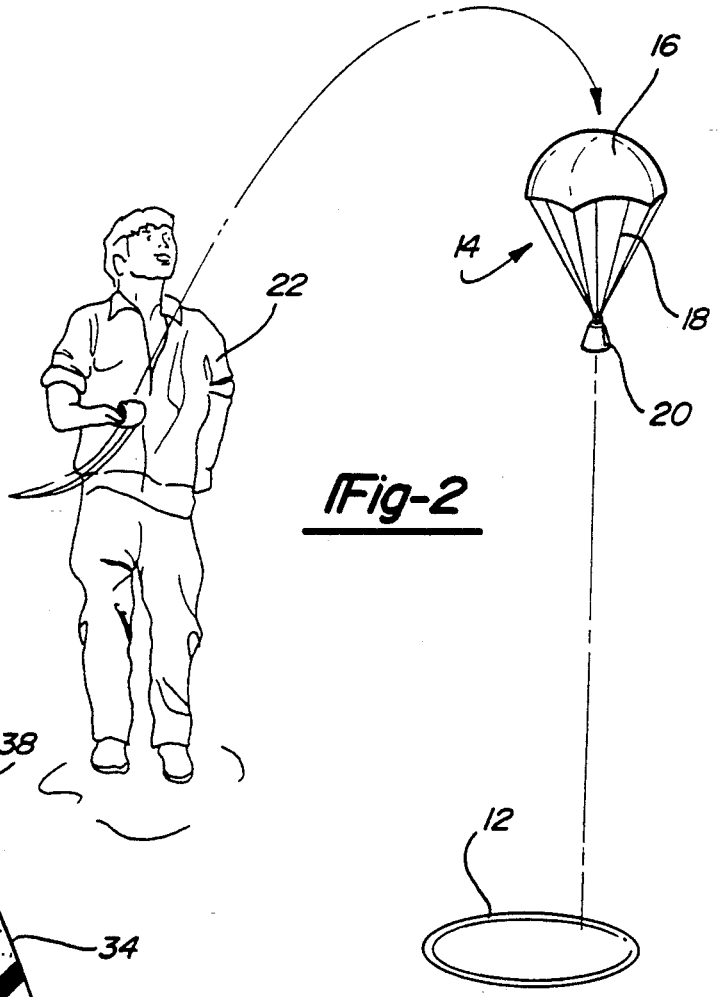
FIG. 2 is a peripheral view of the present invention illustrating a player participating in game play.

With reference to FIG. 2, the parachute game 10 is shown being used by a player 22. To play the game 10, the player 22 rolls the canopy 16, the cords 18 and the body portion 20 together, takes aim at the target 12, and releases the assembly 14 into the air in the general direction of the target 12. The object is to aim the assembly 14 so that it lands within the target 12.

As illustrated, when free falling, the canopy 16 becomes hemispherical by captured air to assist in retarding the speed of descent and to aid in accurate targeting. When this occurs, the cords 18 appear conically arrayed in their extended positions, as illustrated. Of course, more than one canopy 16 may be attached to the body portion 20.

Preferably, each player 22 has his own assembly 14 for play, although the game 10 may include only one assembly for use by all of the players 22. Alternatively, the game 10 may be played by only one player 22.

Figure 3:
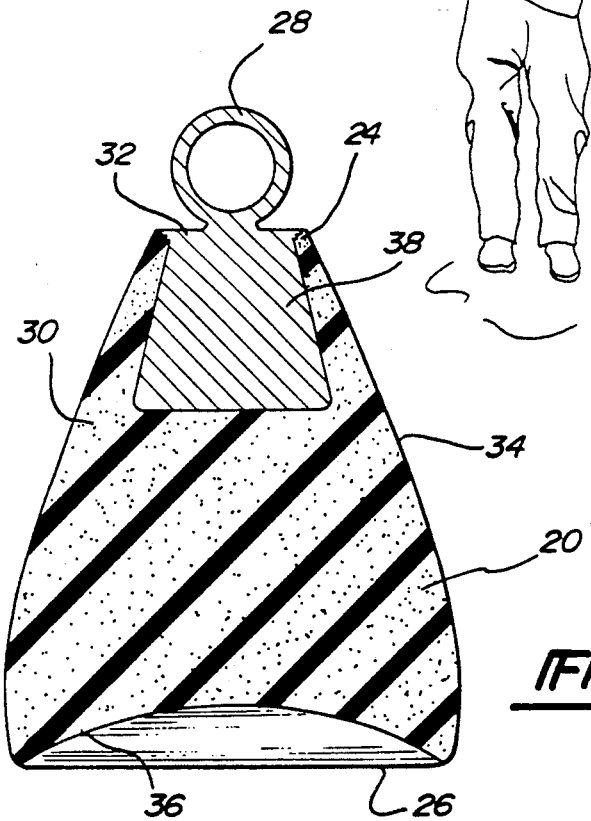
FIG. 3 is a cross-sectional view of a preferred embodiment of the body portion of the present invention.

With reference to FIG. 3, a detailed view of the body portion 20 is illustrated in cross section as a preferred embodiment. The body portion 20 comprises a body 30 including an upper end 24 and a bottom side 26. The upper end 24 has fitted thereto a cord attachment ring 28. The ring 28 is provided for removable attachment of the cords 18 (FIGS. 1 and 2) thereto.

The ring 28 is anchored to the body 30 by a ring base 32 that is preferably molded into the body 30.

The body 30 is preferably composed of a polymerized material such as an expanded or foamed plastic. The body 30 may therefore be produced by means of reaction injection molding. The body 30 is preferably covered by a painted or polymerized skin 34 for safety, durability, and to add aesthetic appeal.

The bottom side 26 includes a concave depression 36 centrally located thereon. The depression 36 further assists in retarding the free fall of the body portion 20 while increasing stability. The depth of the depression 36 may be varied to achieve optimum results of descent speed and playing accuracy.

At the under side of the ring base 32 different methods of balancing or weighting the body portion 20 may be fitted therewith. As illustrated, a weight 38 is situated therein around which the body 30 is thereafter molded. The weight 38 may be a conventional fishing-type weight or may be cast as one with the ring 28 and the ring base 32.

Figure 4:
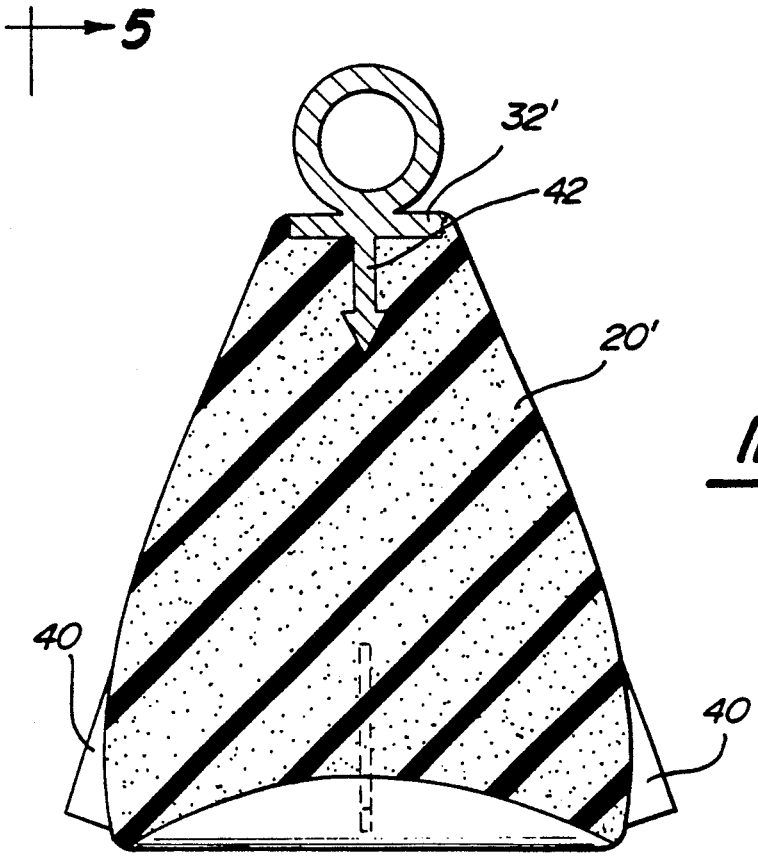
FIG. 4 is a view similar to that of FIG. 3 illustrating an alternate embodiment of the present invention.

Referring to FIG. 4, an alternate embodiment of the body portion, illustrated here as 20', is shown. According to this embodiment, a plurality of axially provided stabilizing vanes 40 are shown fitted exteriorly to the body portion 20'. The vanes 40 assist in the prevention of the twisting of the body portion 20' as it descends from its maximum-tossed elevation. Preferably, there are four of the vanes 40 provided as the body portion 20', although more or less vanes 40 may be provided as optimum operation dictates.

A ring base 32' according to this embodiment is anchored by a ring base anchor 42. The ring base anchor 42 may either be molded as one with the body portion 20' upon manufacture or may be pressed in and force-fitted after molding.

To further minimize twisting upon descent, the attachment point of the cords 18 may also be modified.

Figure 5:
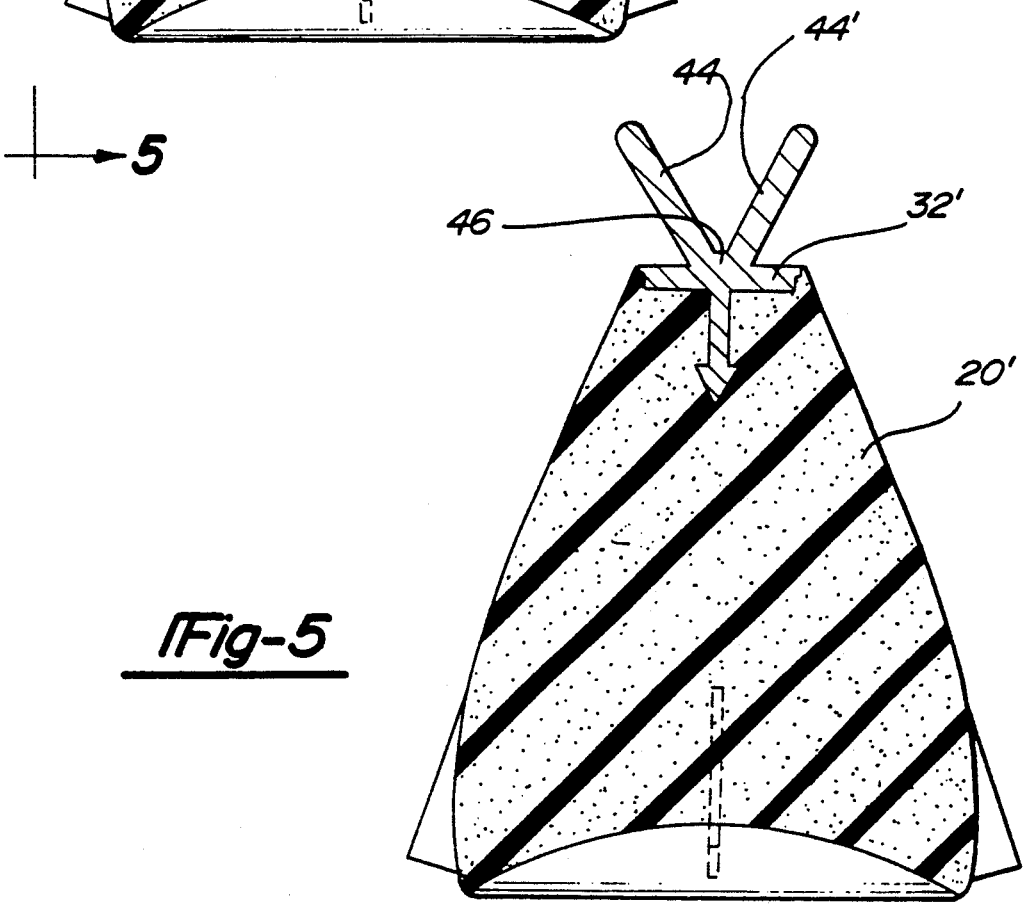
FIG. 5 is a view taken along lines 5—5 of FIG. 4.

Accordingly, and with reference to FIG. 5, a system of providing a pair of attachment rings 44, 44' is provided. The rings 44, 44' have a common attachment point 46 at the top side of the ring base 32'. The rings 44, 44' thereby have a spaced-apart relationship at their upper ends. A "V" configuration is formed in cross section.

The cords 18 are selectively attached to the rings 44, 44' whereby twisting of the body portion 20' is minimized.

Figure 6:
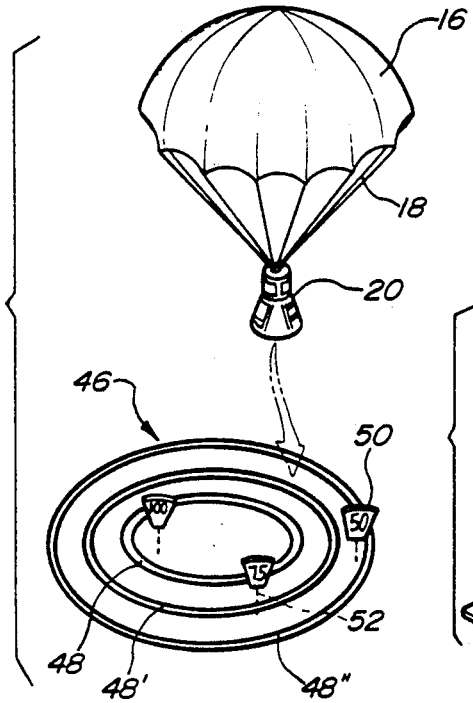
FIG. 6 is a peripheral view of an alternate embodiment of a target.

Referring to FIG. 6, a detailed view of a preferred embodiment of a target of the present invention is disclosed. This embodiment includes a target generally indicated as 46. The target 46 includes one or more markers 48. The markers are indicated as being circular, but other shapes and configurations may be used as preferred.

While a single marker 48 may be used, a plurality of such markers is deemed to be more competitive and is accordingly preferred. This is illustrated in FIG. 6 which shows three concentric markers 48, 48', 48''. In lieu of the concentric layout, markers could be spread about (not shown). In any configuration, one or more signs 50 may be included to indicate the different score values obtainable for each marker. The signs 50 may be attached to the markers or may be provided independent of the markers as illustrated. The signs 50 may include prongs 52 for insertion into the soil.

Figure 7:
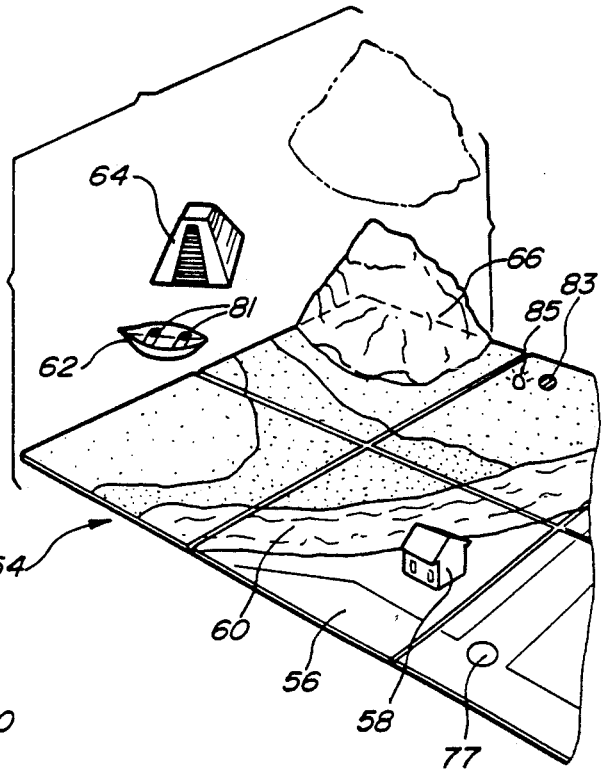
FIG. 7 is a peripheral view of an additional embodiment of the target of the present invention.

FIG. 7 discloses an optional form of a target according to the present invention. According to this embodiment, the target, generally indicated as 54, includes a sheet 56 preferably having printed thereon a miniature terrain. The terrain scene may be a natural area or may be a city plan. The sheet 56 may be composed of a rubber or plastic. To add realism, the sheet 56 may be molded to define a relief. If a thin, flat material is used, the sheet 56 may have defined thereon a plurality of preformed creases.

To further add detail and realism, the target 54 may include features such as a miniature building 58, a miniature body of water 60, a miniature vehicle such as a boat 62, or a miniature monument 64. A natural elevation such as a hill or mountain 66 may also be included. With this life-like terrain, the players may seek to land the body 20 on one or the other of particular features set forth above. Points are then earned according to the area hit by the body 20.

Figure 8:
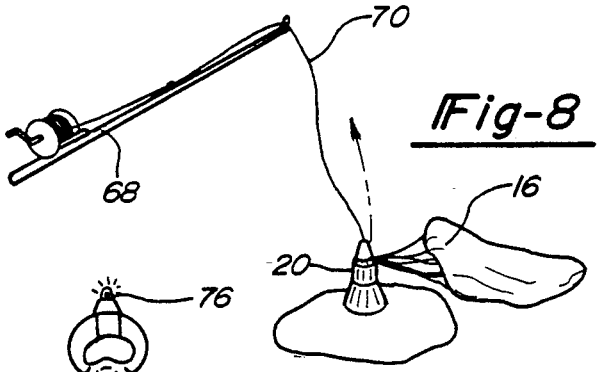
FIG. 8 is a peripheral view of a rod and reel assembly for casting the body and parachute assembly.

As shown in FIG. 2 and discussed in relation to that figure, the preferred method of propelling the body 20 toward the target is to have the player 22 toss the assembly 14. As an alternate method of propelling the assembly, a reel may be used. This is shown in FIG. 8. With respect to that figure a pole and reel assembly 68 is used. The pole and reel assembly 68 includes a line 70. The end of the line 70 may be attached directly to the body 20 as shown, or may be attached to the parachute 16. In use, the player can either cast the assembly 14 in the manner used for fly casting,,, or may carefully direct the assembly 14 to the target. The latter approach may be made more competitive by using a long pole.

The body 20 has been illustrated above as a pear-shaped object with wings. However, there are variations of this shape that more closely represent miniature objects with which most players are more familiar. For example, in FIG. 6, the body 20 is illustrated as being a space capsule. Of course other space vehicles could be used as models.

Figure 9:
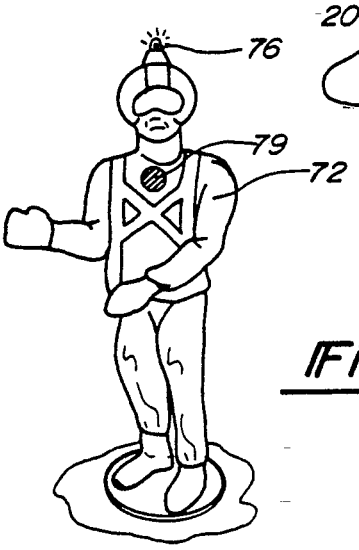
FIG. 9 is a peripheral view of one shape of the body disclosing a human form.

The appearance of the body 20 need not be limited to the shape of a space capsule. For example, referring to FIG. 9, the body could be illustrated as a parachutist 72. Many variations of the human form are possible including soldiers, police, firefighters and the like.

Figure 10:
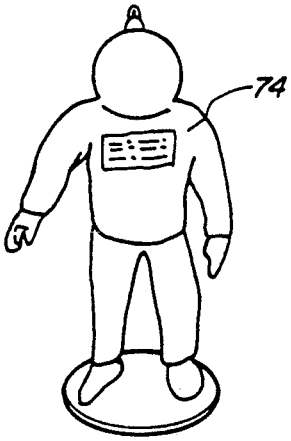
FIG. 10 is a peripheral view of yet another shape of the body disclosing an imaginary alien form.

As a further variation of the appearance of the body, FIG. 10 illustrates an imaginary alien 74. The alien 74 may be of many possible variations.

To add more interest to the parachute game of the present invention, an announcing system may be incorporated. For example, the parachutist 72 may include a light 76 that is illuminated when the body hits a particular target. This may be accomplished by having a pair of contacts, one fitted to each foot. When the parachutist 72 hits a metal piece on the target such as a metal piece 77, the circuit is closed, and the light 76 is illuminated. In lieu of or in addition to the light 76, a buzzer 79 may sound.

As an alternative to the announcing system provided in the body, the target itself may incorporate an announcing system. For example, if the body lands upon the boat 62 a circuit 81 may be closed in the target and either an alarm 83 or a light 85 (or both) can signal contact with the target.

Having described my invention, many modifications thereto will become apparent to those skilled in the art to which it pertains without deviation from the spirit of the invention as defined by the scope of the appended claims.

I claim:

1. A parachute game comprising:

a parachute assembly, said assembly including a body and a parachute, said parachute being attached to said body; and a target;

said body including means for announcing if said body falls upon a selected part of said target.

2. The parachute game of claim 1 wherein said body is in the form of a miniature space vehicle.

3. The parachute game of claim 1 wherein said body is in the form of a human.

4. The parachute game of claim 1 wherein said body is in the form of an imaginary creature.

5. The parachute game of claim 1 wherein said means for announcing comprises a sound-producing unit.

6. The parachute game of claim 1 wherein said means for announcing comprises a light-producing unit.

7. The parachute game of claim 1 wherein said parachute assembly is shaped to be held in and tossed from the hand of said player.

8. The parachute game of claim 1 wherein said parachute assembly is suspended from a line held by said player.

9. The parachute game of claim 8 wherein said line is attached to a rod and reel.

10. The parachute game of claim 1 wherein said target comprises a marker.

11. The parachute game of claim 10 wherein said target further includes a sign, said sign having imprinted thereon a score value.

12. The parachute game of claim 10 wherein said target comprises a plurality of said markers.

13. The parachute game of claim 12 wherein each of said markers is defined by a continuous surface having an open center.

14. The parachute game of claim 13 wherein said markers are concentric.

15. The parachute game of claim 1 wherein said target comprises a continuous sheet.

16. The parachute game of claim 15 wherein said sheet has printed thereon an image of a miniature terrain.

17. The parachute game of claim 15 wherein said target further includes a miniature building.

18. The parachute game of claim 15 wherein said target further includes a miniature vehicle.

19. The parachute game of claim 15 wherein said target further includes a miniature monument.

20. The parachute game of claim 15 wherein said target further includes a miniature natural elevation.

21. The parachute game of claim 15 wherein said target further includes a miniature body of water.

22. The parachute game of claim 1 wherein said game further includes means for announcing whether or not said target has been hit in a selected place by said parachute assembly after said assembly is propelled by a player.

* * * * *